US007014597B2

(12) United States Patent
Tsai

(10) Patent No.: US 7,014,597 B2
(45) Date of Patent: Mar. 21, 2006

(54) WALK SIMULATING MACHINE

(75) Inventor: Shih-Chang Tsai, Tainan Hsien (TW)

(73) Assignee: Tonic Fitness Technology, Inc., (TW)

( * ) Notice: Subject to any disclaimer, the term of this patent is extended or adjusted under 35 U.S.C. 154(b) by 7 days.

(21) Appl. No.: 10/822,649

(22) Filed: Apr. 13, 2004

(65) Prior Publication Data

US 2005/0227816 A1 Oct. 13, 2005

(51) Int. Cl.
*A63B 22/06* (2006.01)
*A63B 22/00* (2006.01)

(52) U.S. Cl. ..... 482/52; 482/57; 482/70

(58) Field of Classification Search ..... 482/51, 482/52, 70, 79–80
See application file for complete search history.

(56) References Cited

U.S. PATENT DOCUMENTS 5,951,892 A * 9/1999 Wolfla et al. ..... 219/121.69
5,971,892 A * 10/1999 Lee ..... 482/52
6,368,252 B1 * 4/2002 Stearns ..... 482/52
6,485,395 B1 * 11/2002 Stearns et al. ..... 482/57
6,569,061 B1 * 5/2003 Stearns et al. ..... 482/52

* cited by examiner

*Primary Examiner*—Stephen R. Crow
(74) *Attorney, Agent, or Firm*—Bacon & Thomas, PLLC

(57) ABSTRACT

A walk simulating machine is provided with two side connecting rods for supporting two pedal connecting rods. Each side connecting rod consists of an upper and a lower connecting rod pivotally connected with each other, the upper connecting rod fixed with a horizontal rod, while the lower connecting rod able to sway back and forth together with the pedal connecting rod. Thus, when the upper and the lower connecting rod are positioned in a straight line and in a non-straight line, the sway pivot of the front end of the pedal connecting rod will be different and hence the front end of the walking orbit will turn upward a bit, able to keep a user's body stable when exercising walk thereon. The upper connect rods can be driven by a slope adjuster to change its positional angles and synchronously change the angles of the walking orbit.

6 Claims, 12 Drawing Sheets

WALK SIMULATING MACHINE

BACKGROUND OF THE INVENTION

1. Field of the Invention

This invention relates to a walk simulating machine, particularly to one having the front end of its walking orbit designed to turn upward a little to enable a user to walk thereon steadily, able to eliminate the drawback of a conventional walking machine with an egg-shaped oval and water-drop-shaped walking orbit which is likely to force a user's body slant forward and slip or fall off the pedals owing to unstable posture caused by the improper center of gravity when the user makes exercise using the conventional walking simulating machine.

2. Description of the Prior Art

Generally, a conventional walking simulating machine has an egg-shape oval walking orbit fro the movement of the pedals with the front end portion of the orbit inclining down; therefore, when a user makes exercise of walking on pedals of the machine, his body will unsteadily slant forward. To prevent the body from slanting forward to avoid slipping and falling off the pedals, a user usually has the center of gravity of his body supported by the fingers of the feet, thus possible to result in sports injuries (such as a cramp of the foot) and not conforming to ergonomics design.

SUMMARY OF THE INVENTION

The objective of the invention is to offer a walk simulating machine having the front end of its walking orbit of the pedals designed to turn upward a bit. Thus, when a user exercises walking with the feet stepping on the pedals, the heels of the user's feet may land first on the ground, that is, the center of gravity of his body will be completely supported by the heels of the feet, enabling a user to exercise walking thereon steadily and with the structure of the walk simulating machine conforming to ergonomics design.

A first feature of the invention is two vertical side connect rods having their lower ends respectively and pivotally connected with the front ends of two pedal connecting rods. Each vertical side connect rod consists of an upper and a lower connecting rod pivotally connected with each other. The upper connecting rods are fixedly positioned, while the lower connecting rods are able to sway back and forth together with the two pedal connecting rods. Thus, when the upper and the lower connecting rod are positioned in a straight line and in a non-straight line, the sway pivots of the front ends of the pedal connecting rods will be different and hence the front end of the walking orbit will turn upward a little, able to let a user's heels land on the ground first and keep his body steady when the user exercises walking on the pedals of the machine.

A second feature of the invention is a slope adjuster able to drive the upper connecting rods and adjust them to a certain positional angle. Thus, when the upper connecting rods are driven to change their positional angles, the angles of the walking orbit will synchronously be changed, forming a simulated slopping-up or slopping-down or horizontal condition for a user to make exercise of walking.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
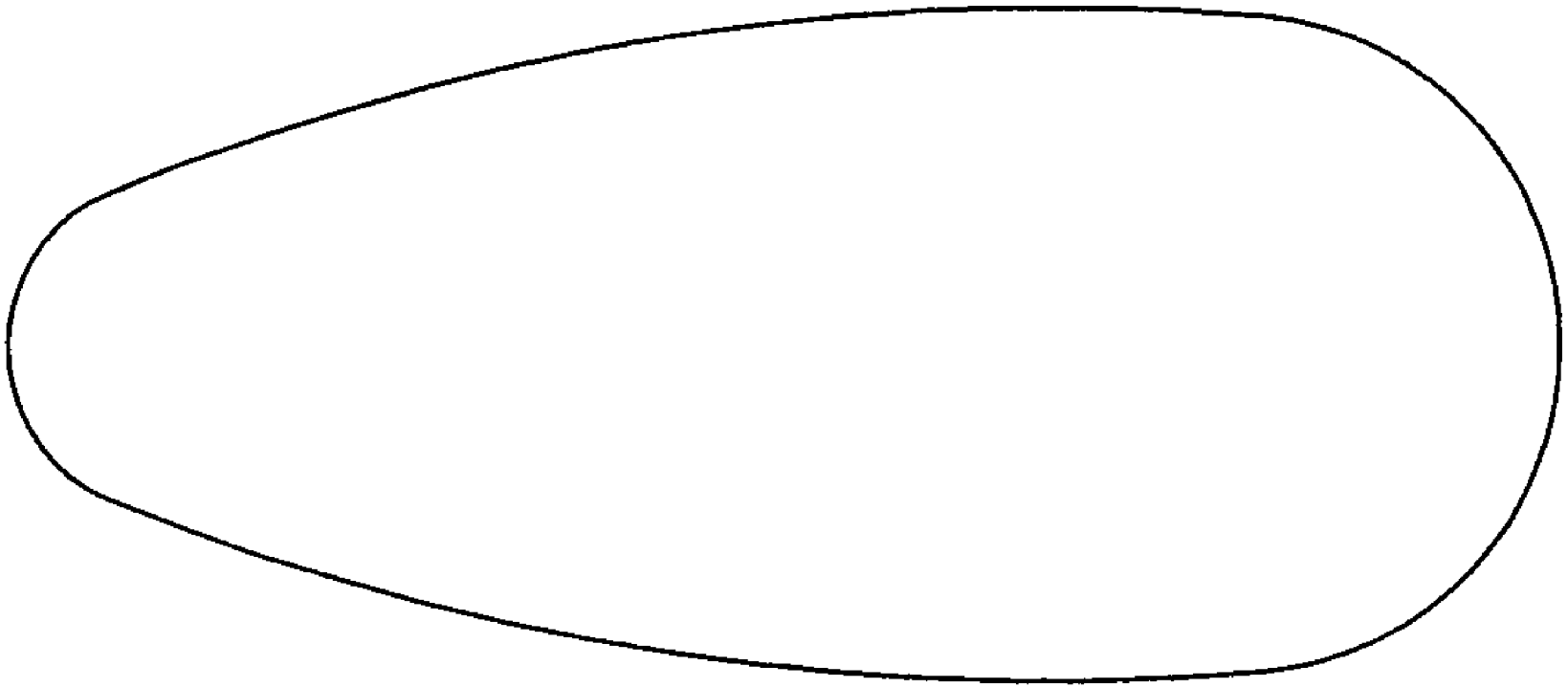
FIG. 1 (PRIOR ART)
FIG. 1 is an upper view of the walking orbit formed by movement of the pedals of a conventional walking simulating machine.
Figure 2:
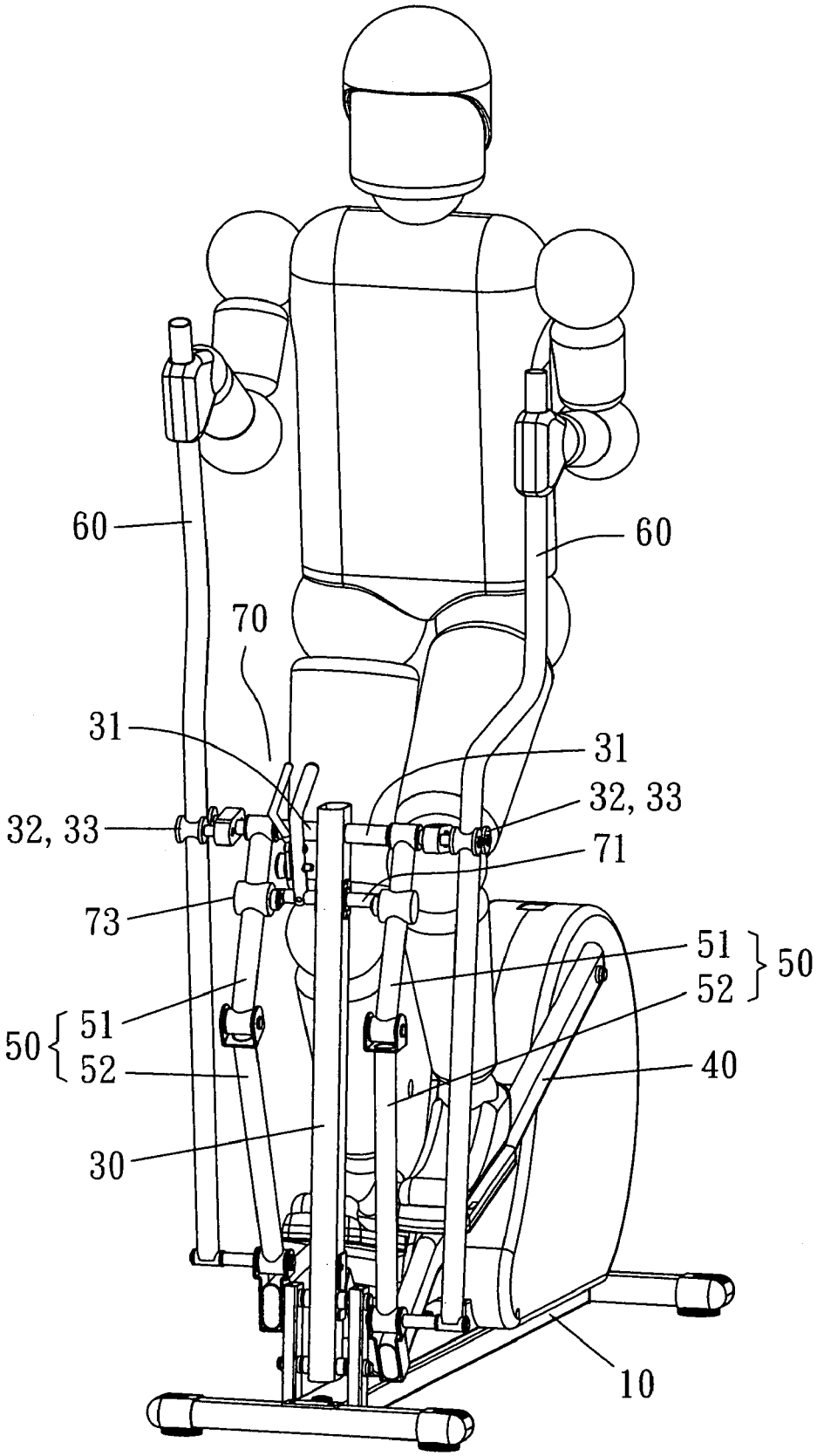
FIG. 2 is a perspective view of a walk simulating machine in the present invention.
Figure 3:
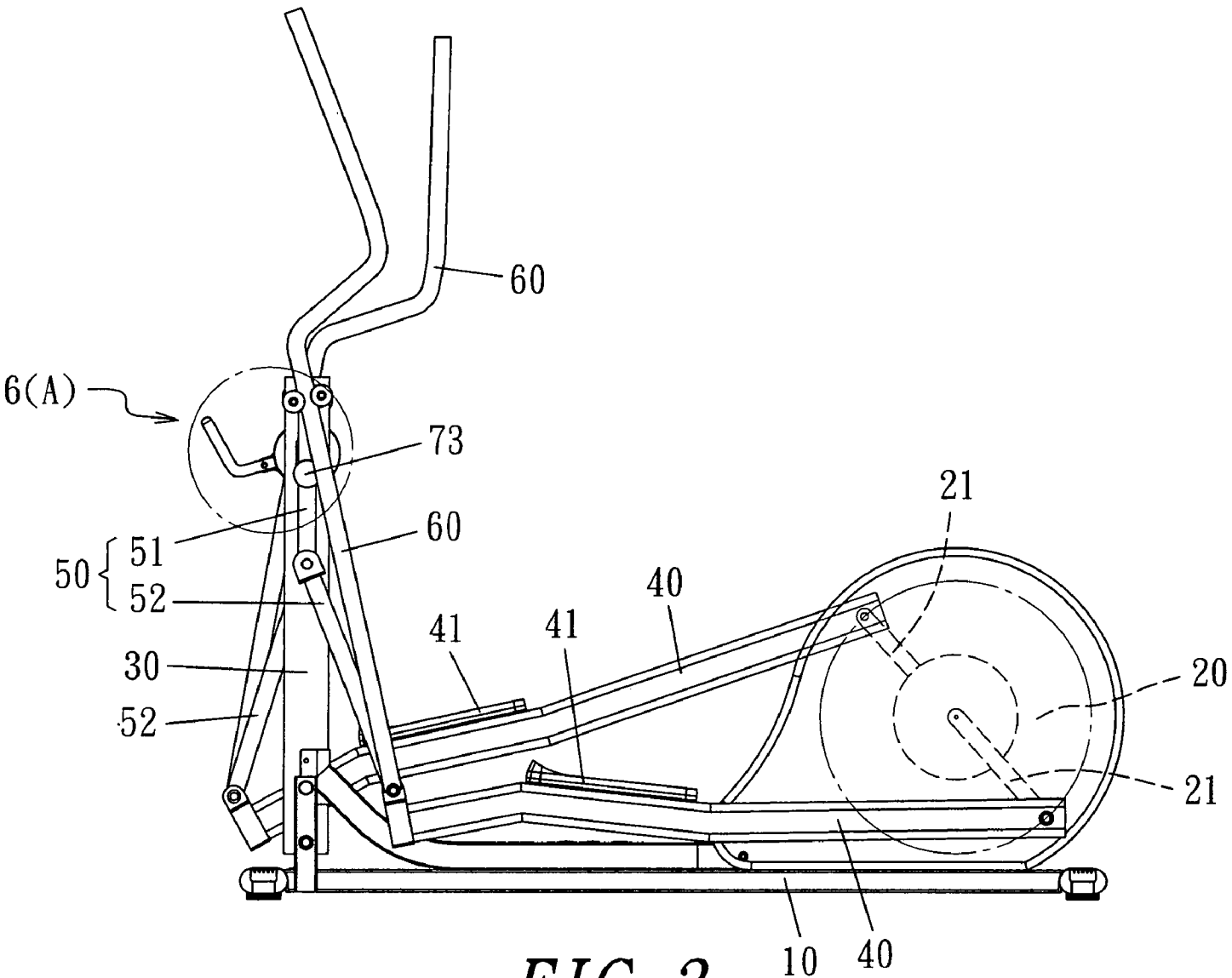
FIG. 3 is a side cross-sectional view of the walk simulating machine in the present invention.

A preferred embodiment of a walk simulating machine in the present invention, as shown in FIGS. 2 and 3, includes a base 10, a crank unit 20, a front post 30, two pedal connecting rods 40, two vertical side connecting roods 50, two hand-control connecting rods 60, and a slope adjuster 70 as main components combined together.

The base 10 stands on the ground for supporting other components thereon.

The crank unit 20, as shown in FIG. 3, is fixedly assembled on the rear upper side of the base 10, having its opposite sides respectively and pivotally connected with a crank 21 and formed with an angular difference of 180 degrees between the two cranks 21.

Figure 4:
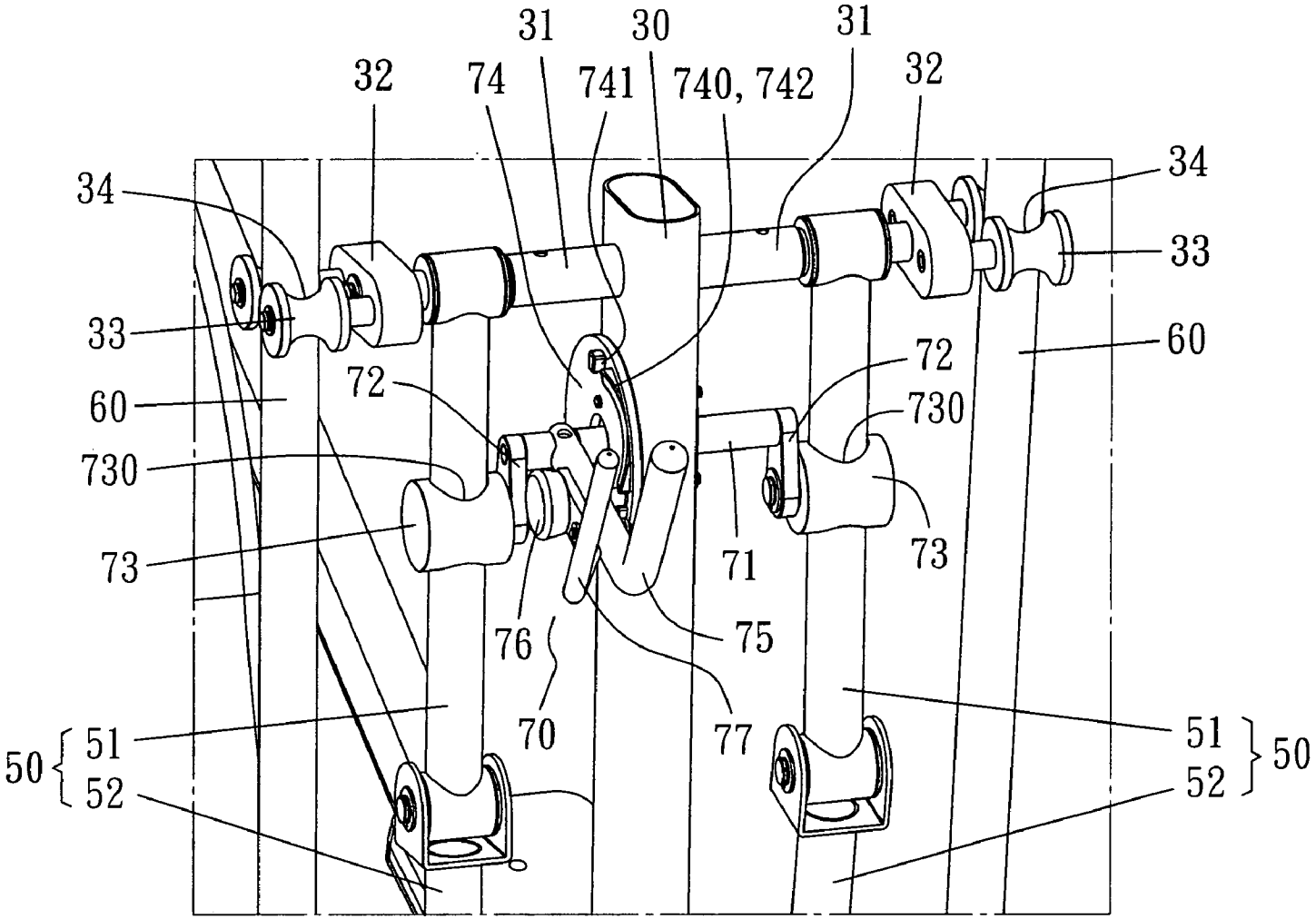
FIG. 4 is a partial cross-sectional view of the walk simulating machine in the present invention.

The front post 30 is fixed with the front end of the bottom base 10, extending upward vertically and having the opposite sides of its upper end respectively provided with a horizontal rod 31 extending outward, as shown in FIGS. 2 and 4. The horizontal rod 31 has outer ends respectively and pivotally connected with a roller supporting member 32 having its outer end provided with two rollers 33 having a gap 34 formed therebetween.

The two pedal connecting rods 40, as shown in FIG. 3, are respectively positioned at the opposite sides of the base 10, respectively having the rear end pivotally connected with the outer end of each crank 21 and the upper front portion secured with a pedal plate 41 to be treaded by a user.

The two vertical side connecting rods 50, as shown in FIGS. 2 and 4, are respectively positioned at the two sides of the front post 30. Each side connecting rod 50 consists of an upper connecting rod 51 and a lower connecting rod 52 pivotally connected with each other. The upper connecting rods 51 have their upper ends pivotally connected with the horizontal rod 31, while the lower connecting rods 52 have their lower ends respectively and pivotally connected with the front ends of the two pedal connecting rods 40.

The two hand-control connecting rods 60, as shown in FIGS. 2 and 3, are respectively positioned at the two sides of the front post 30, having the lower ends respectively and pivotally connected with the front ends of the two pedal connecting rods 40 and the upper ends respectively passing through the gap 34 between the two rollers 33 of the roller supporting member 32 and extending upward to be held by a user.

The slope adjuster 70, as shown in FIGS. 2 and 4, is secured with the front post 30 and positioned under the horizontal rod 31. The slope adjuster 70 is provided with a slope adjusting rod 71 transversely inserted through the front post 30 and having two ends respectively extending outward and located at the opposite sides of the front post 30. The slope adjusting rod 71 has two ends respectively fixed with a crank 72 having the other end pivotally connected with an interacting block 73 bored with a vertical through hole 730 in the center, as shown in FIG. 4. Thus, the upper connecting rod 51 can be inserted through the through hole 730 of the interacting block 73 and has its upper end pivotally connected with the hang rod 31, while the lower connecting rod 52 has its lower end pivotally connected with the front end of the pedal connecting rod 40.

In addition, the slope adjuster 70 is provided with a positioning disk 74, an adjusting lever 75, a locking pin 76 and a pressing rod 77.

Figure 6B:
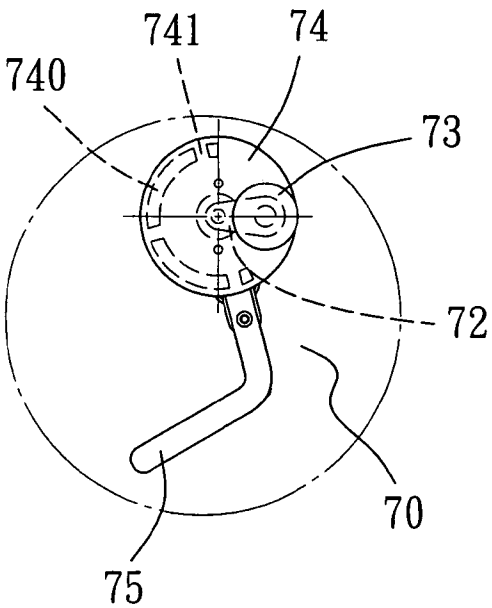
FIG. 6(B) is a side cross-sectional view of the slope adjuster adjusted to a slopping-up condition in the present invention.
Figure 6A:
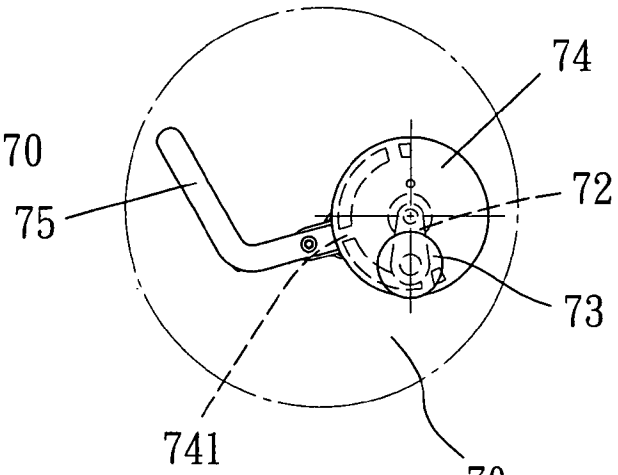
FIG. 6(A) is a side cross-sectional view of a slope adjuster adjusted to a horizontal condition in the present invention.
Figure 6C:
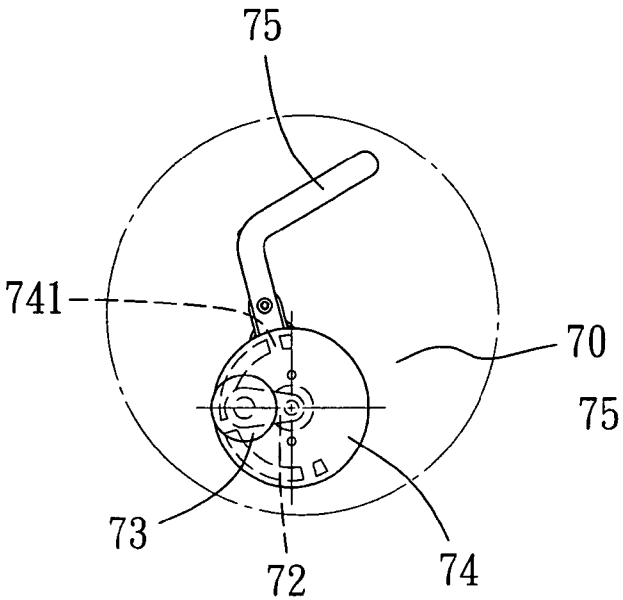
FIG. 6(C) is a side cross-sectional view of the slope adjuster adjusted to a slopping-down condition in the present invention.

The positioning disk 74 has one side secured with the front post 30 and the other side provided with an arc-shaped projecting rib 740 having plural positioning recesses 741 separately formed at the locations of preset angular difference, with the projecting rib 740 between every two positioning recesses 741 formed with an arc-shaped recessed surface 742, as shown in FIGS. 4 and 6 (A).

Figure 5:
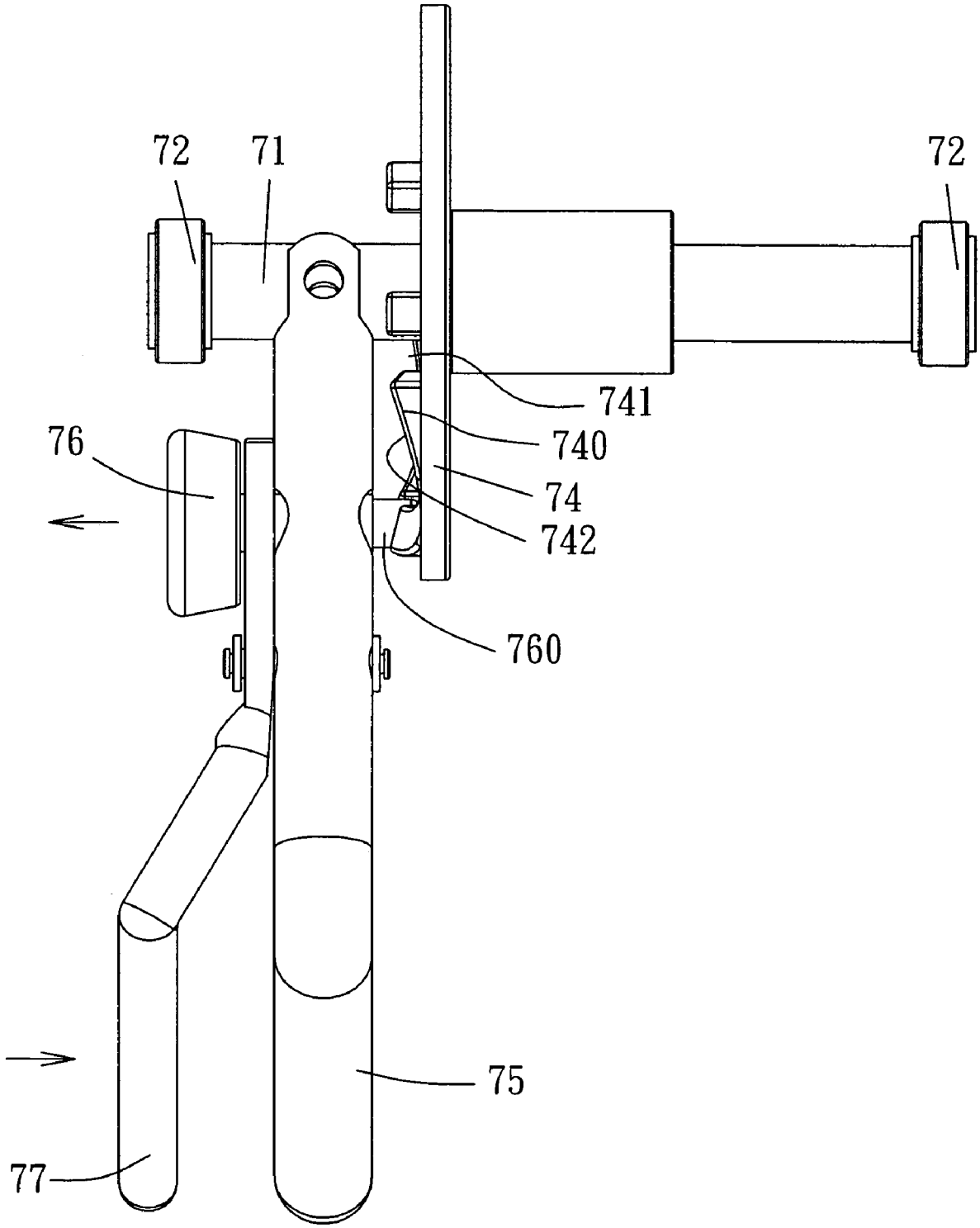
FIG. 5 is a partial front upper view of the front portion of the walk simulating machine in the present invention.

The adjusting lever 75 having its upper end vertically fixed with the slope adjusting rod 71 and the other end bent and extending to the front of the front post 30, able to drive the slope adjusting rod 71 to move together, as shown in FIGS. 4 and 5.

The locking pin 76 has one end transversely inserted through the adjusting lever 75, having its engage end 760 resting on the projecting rib 740 of the positioning disk 74 to be engaged and positioned in the positioning recesses 741. The locking pin 76 is provided inside with a spring for forcing elastically the engage end 760 to always push against the projecting rib 740.

The pressing rod 77 has its intermediate portion pivotaily connected with the adjusting lever 75, having one end inserted in a connecting portion between the adjusting lever 75 and the engage end 760 of the locking pin 76. When the pressing rod 77 is pulled toward the adjusting lever 75, its other end will by leverage actuate the engage end 760 of the locking pin 76 and compress the inner spring to disengage the engage end 760 from one of the positioning recesses 741 of the projecting rib 740, as indicated by the arrows in FIG. 5. Thus, the adjusting lever 75 can be pulled to actuate the slope adjusting rod 71 and the interacting blocks 73 to shift together and synchronously actuate the upper rods 51 to shift and change its positional angle. Apart from being handled manually, the slope adjuster 70 can also be controlled by an electrically controlled device (such as a motor) to drive the slope adjusting rod 71 to shift and adjust its positional angles.

After the walk simulating machine is assembled, its walking orbit can be adjusted into three conditions for use.

Figure 7:
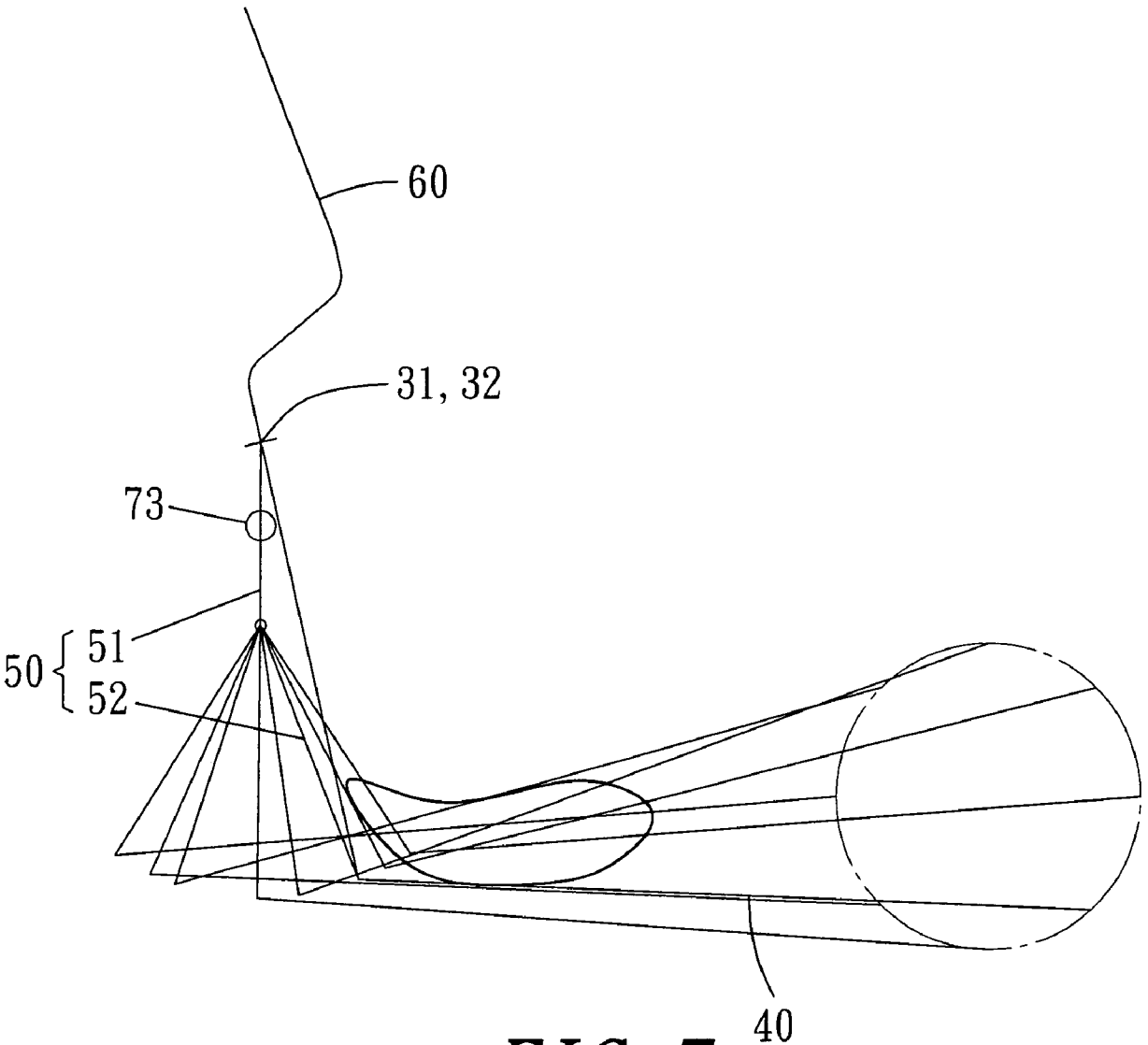
FIG. 7 is a side cross-sectional view of a walking orbit adjusted to a horizontal condition in the present invention.

1. The walking orbit is adjusted in a horizontal state when the upper connecting rods are controlled by the slope adjuster 70 to extend downward vertically, as shown in FIGS. 3 and 6 (A). In this condition, when a user has its feet standing on the pedals plates 41 of the pedal connecting rods 40 and his hands holding the upper ends of the two hand-control connecting rods 60 and begins pedaling, there will form the same walking orbit as shown in FIG. 7. When the upper connecting rods 51 are kept motionless and the lower connecting rods 52 swing in alignment with the upper connecting rods 51, the swing pivot of the upper and the lower connecting rods 51, 52 is the horizontal rod 31. When the lower connecting rods 52 sway and deflect from the upper connecting rods 51, the sway pivot of the lower connecting rod 52 is the pivotal joint of the upper and the lower connecting rod 51 and 52.

Figure 8:
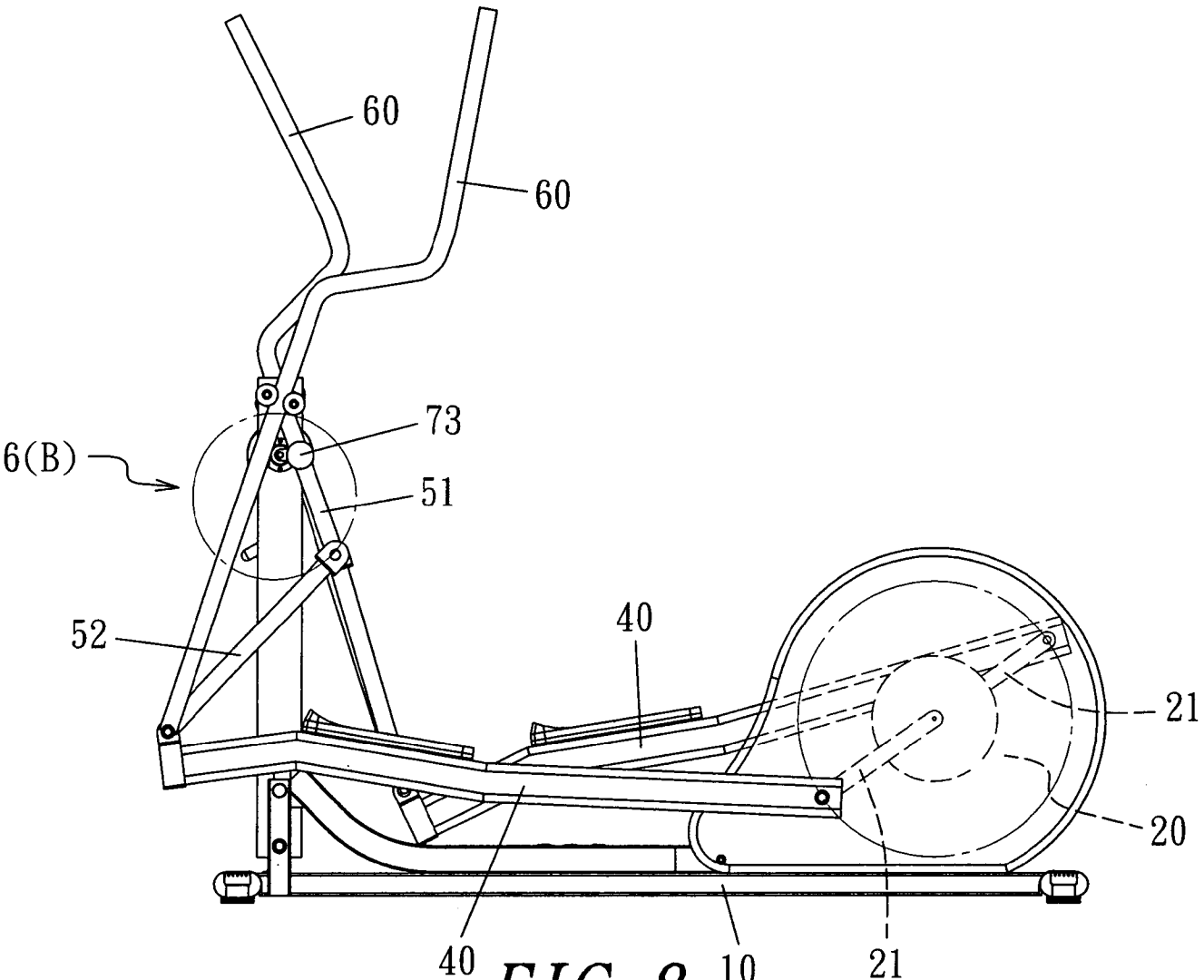
FIG. 8 is a side cross-sectional view of the walk simulating machine having its walking orbit adjusted to an slopping-up in the present invention.
Figure 9:
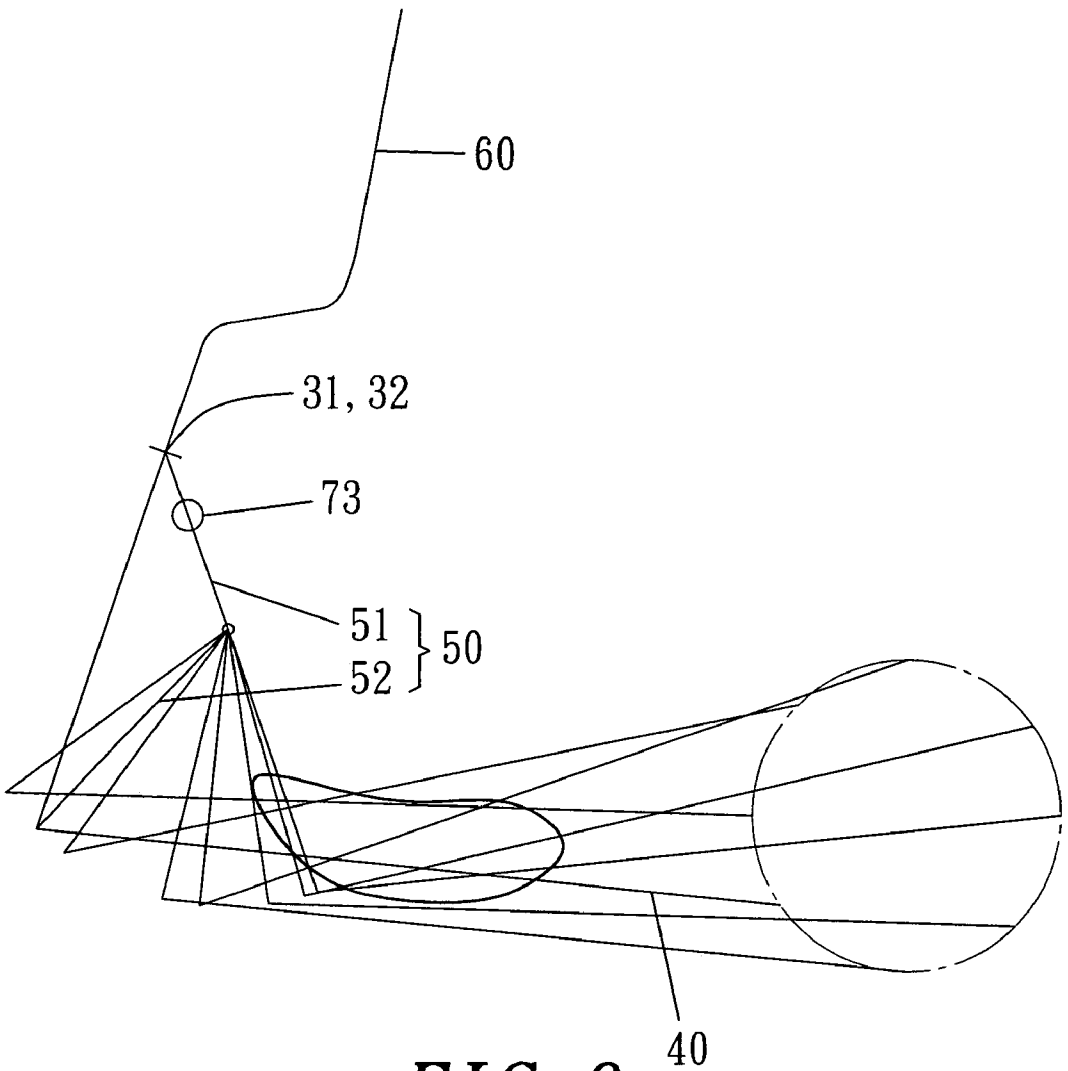
FIG. 9 is a side cross-sectional view of the walking orbit adjusted to the slopping-up condition in the present invention.

2. The walking orbit is adjusted in an slopping-up condition when the adjusting lever 75 is driven to actuate the interacting blocks 73 to make the lower connecting rods 52 shift backward and positioned at a certain angle, as shown in FIGS. 8 and 6 (B). At this time, the walking orbit has its front end turning upward, as shown in FIG. 9, letting a user pedaling thereon feel as if he were training to walk on an upward slope.

Figure 10:
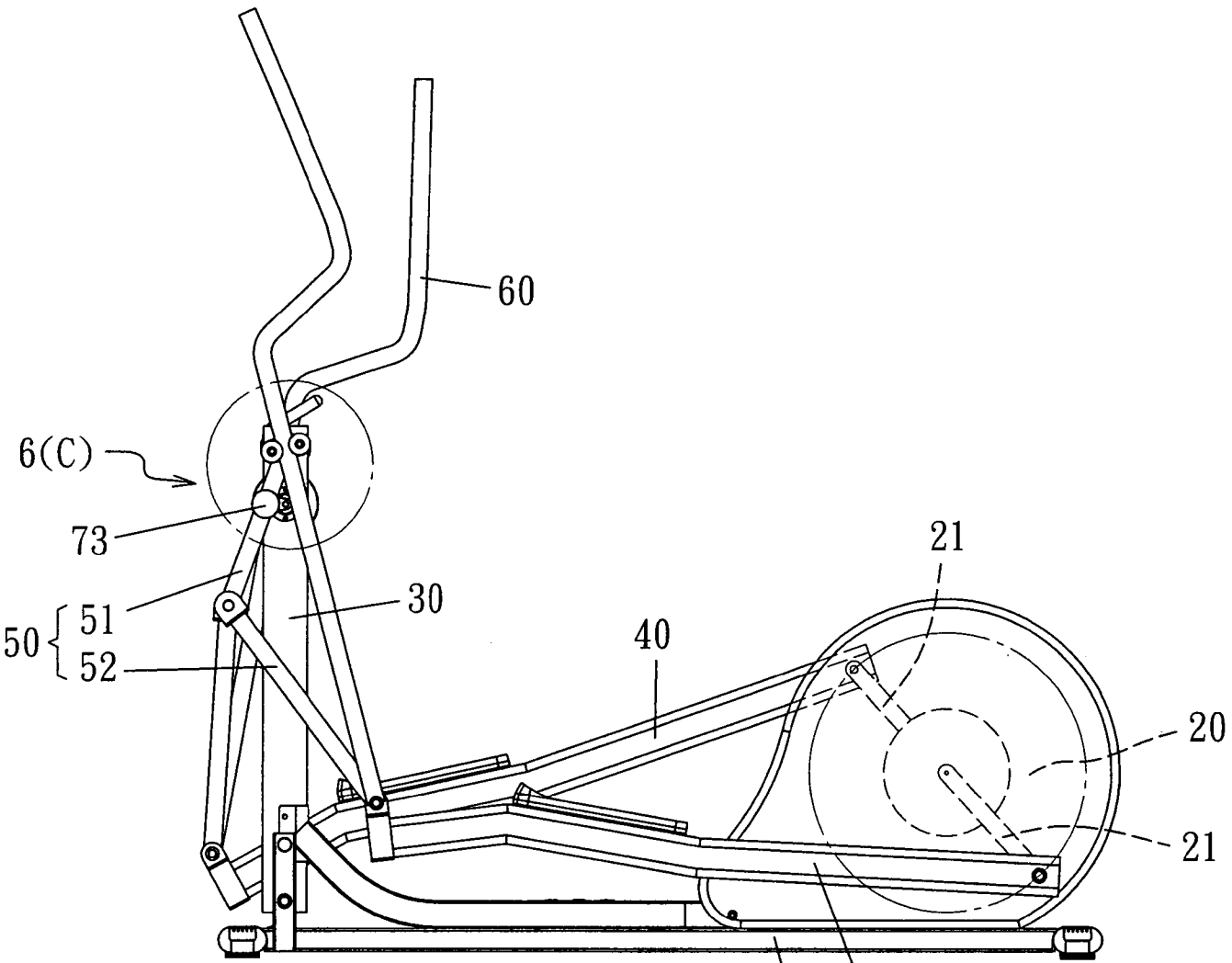
FIG. 10 is a side cross-sectional view of the walk simulating machine having its walking route adjusted to a downward-slope condition in the present invention.
Figure 11:
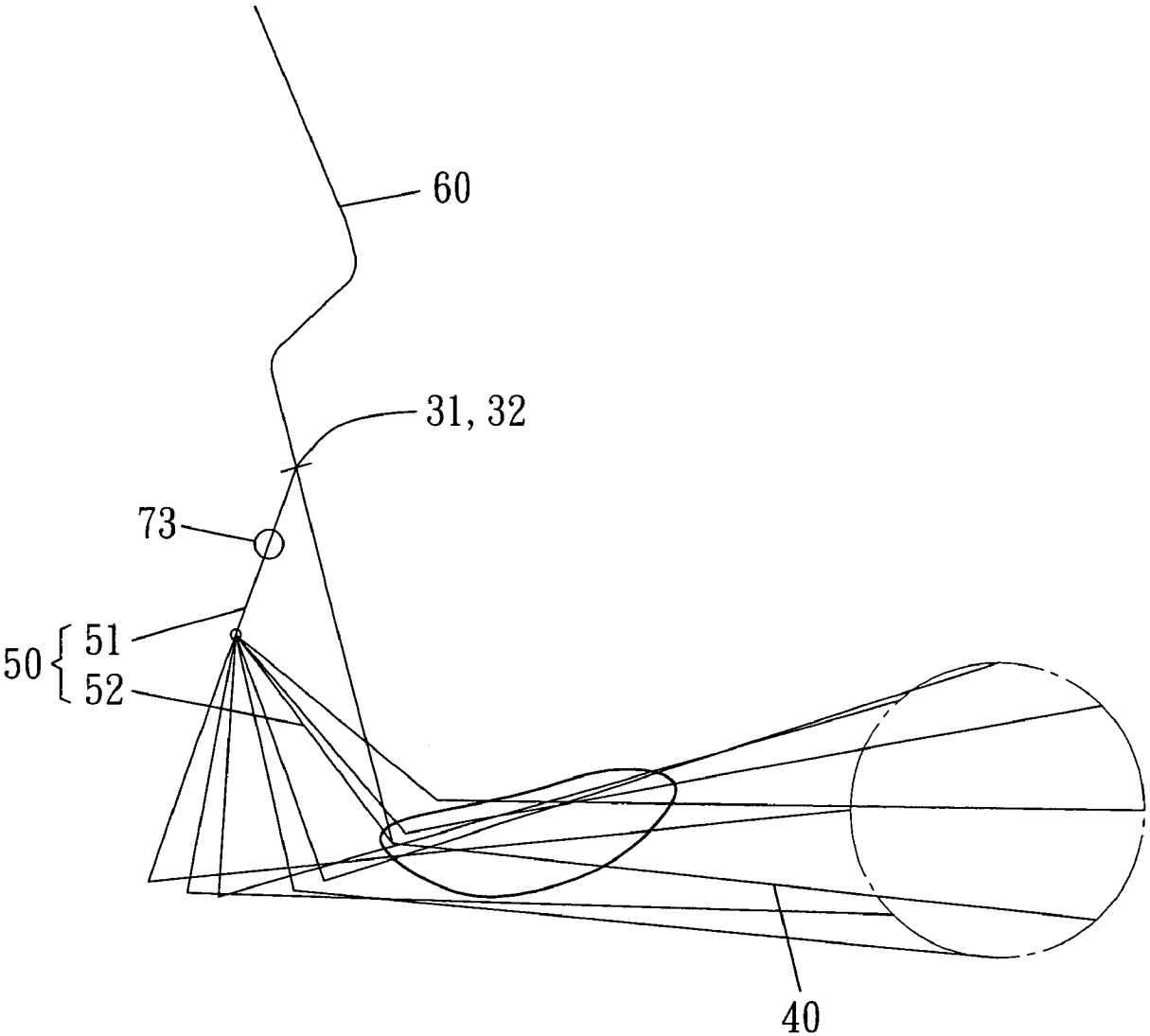
FIG. 11 is a side cross-sectional view of the walk simulating machine in case of the walking orbit adjusted to a slopping-down condition in the present invention.

3. The walking orbit is adjusted in a slopping-down condition when the adjusting lever 75 is driven to actuate the interacting blocks 73 to make the lower connecting rods 52 shift for ward and positioned at a certain angle, as shown in FIGS. 10 and 6 (C). At this time, the walking orbit has its front end slanting downward, as shown in FIG. 11, letting a user pedaling thereon feel as if he were training to walk on a downward slope.

Figure 12:
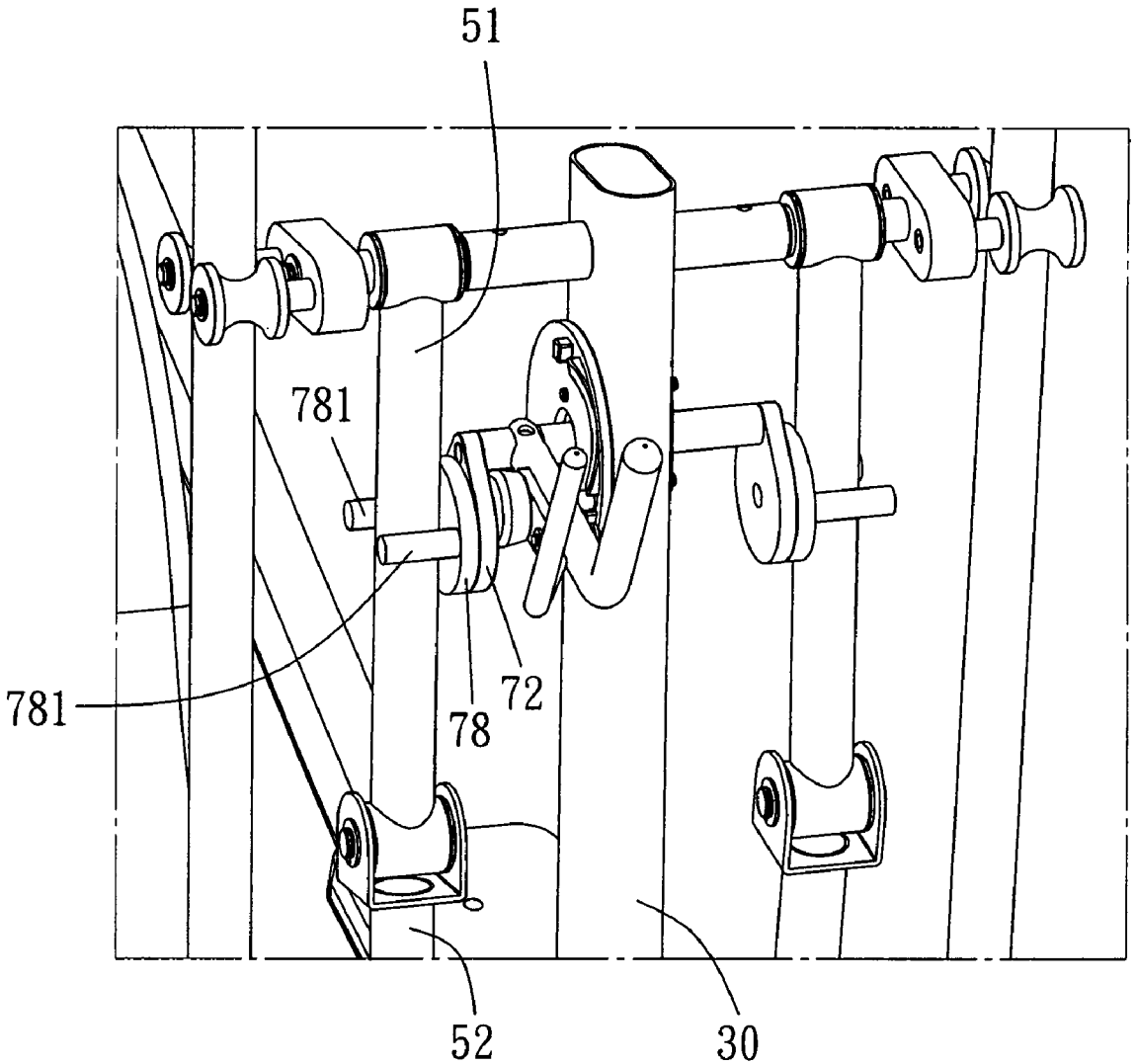
FIG. 12 is a cross-sectional view of another preferred embodiment of position-limiting members of the upper connecting rods in the present invention.
Figure 13:
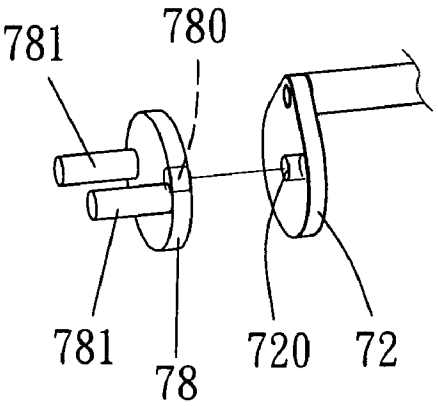
FIG. 13 is an exploded perspective view of the position-limiting member of the upper connecting rod in the present invention.

In addition, a movable disk 78, as shown in FIGS. 12 and 13, can take the place of the interacting block 73, as shown in FIG. 4, for controlling positional shift of the upper connecting rod 51 to. The movable disk 78 is provided vertically, having one side facing the crank 72 provided with a central shaft 780 protruding outward horizontally. The crank 72 has a shaft hole 720 bored in the center and facing the central shaft 780 of the movable disk 78 for receiving the central shaft 780 therein. The movable disk 78 has the other side provided with two position-limiting studs 781 protruding outward transversely to be respectively positioned at the front and the rear side of the upper connecting rod 51.

Since the upper connecting rods 51 are kept motionless when a user steps on the pedal plates 41 to walk, the sway pivot of the lower connecting rods 52 varies when the upper and the lower connecting rod 51, 52 are positioned in a straight line and in a non-straight line. Therefore, the walking orbit will have its front end turning upward a little. Thus, a user's heels can land the on the ground first when he stretches forward the feet for pedaling, able to keep the center of gravity of pedaling steady. Furthermore, when adjusted to a slopping-up or a slopping-down condition, the walking orbit still can keep its front end somewhat turning upward, conforming to ergonomics design and able to avoid sports injuries.

While the preferred embodiment of the invention has been described above, it will be recognized and understood that various modifications may be made therein and the appended claims are intended to cover all such modifications that may fall within the spirit and scope of the invention.

I claim:

1. A walk simulating machine comprising:

a base for supporting other components;

a crank unit fixedly assembled on a rear portion of said base, said crank unit having opposite sides respectively and pivotally connected with two cranks, with an angular difference of 180 degrees formed between said two cranks;

a front post secured on a front end of said base and extending upward vertically, said front post having an upper end provided with a horizontal rod extending outward, said horizontal rod having two outer ends pivotally connected with a roller supporting member, each said roller supporting member provided at an outer end thereof with two rollers having a gap formed therebetween;

two pedal connecting rods respectively positioned at the opposite sides of said bottom base, said two pedal connecting rods having their rear ends respectively and pivotally connected with said two cranks of said crank unit, each said pedal connecting rod fixed on the topside with a pedal plate;

two vertical side connecting rods respectively positioned at the opposite sides of said front post, each vertical connecting rod comprising an upper connecting rod and a lower connecting rod pivotally connected with each other, said two upper connecting rods having their upper ends respectively and pivotally connected with said horizontal rod, said two upper connecting rods controlled not to sway back and forth randomly, said two lower connecting rods having their lower ends respectively and pivotally connected with the front ends of said two pedal connecting rods; and two hand-control connecting rods respectively positioned at the opposite sides of said front post, said two hand-control connecting rods having lower ends respectively and pivotally connected with the front ends of said two pedal connecting rods, said two hand-control connecting rods having upper ends respectively extending upward and slidably inserted through said gap between said rollers, said two hand-control connecting rods having their upper ends positioned above said roller supporting member for a user to hold thereon.

2. The walk simulating machine as claimed in claim 1, wherein said two upper connecting rods of said two vertical side connecting rods are restricted not to sway back and forth arbitrarily by a slope adjuster, which is able to drive said upper connecting rods to shift and deflect to a certain angle, and therefore, based on the positional angular differences of said upper connecting rods, the walking orbit formed by the pedals of said walk simulating machine can be adjusted into various angles to form a horizontal condition or a sloping-up condition or a sloping-down condition.

3. The walk simulating machine as claimed in claim 2, wherein said slope adjuster is provided with a slope adjusting rod, a positioning disk, an adjusting lever, a locking pin and a pressing rod, said slope adjusting rod transversely inserted through said front post and positioned under said horizontal rod, said slope adjusting rod having opposite ends respectively fixed with a crank, each said crank pivotally connected with an interacting block, said interacting block bored with a vertical through hole for each said upper connecting rod to be inserted therethrough, said positioning disk having one side secured with said front post and the other side formed with spaced-apart positioning recesses with positional angular differences, said adjusting lever having its upper end vertically secured with said slope adjusting rod, said locking pin having an engage end transversely inserted through said adjusting lever, said engage end of said locking pin inserted in one of said positioning recesses of said positioning disk, said locking pin having a spring fitted inside to keep said engage end engaged in one of said positioning recesses, said pressing rod having its intermediate portion pivotally connected with said adjusting lever, said pressing rod having one end inserted in a connecting portion between said locking pin and said adjusting lever, said pressing rod pullable to control said engage end of said locking pin to disengage from one of said positioning recesses of said positioning disk, said upper connecting rod restricted not to sway back and forth randomly by said slope adjuster, said upper connecting rod able to be adjusted to a certain.

4. The walk simulating machine as claimed in claim 2, wherein said slope adjuster is provided with a slope adjusting rod and an electrically-controlled device, said slope adjusting rod transversely inserted through said front post and positioned under said horizontal rod, said slope adjusting rod having opposite ends respectively connected with a crank, each said crank having an outer side pivotally connected with an interacting block, said interacting block bored with a vertical through hole for each said upper connecting rod to pass therethrough, said electrically-controlled device driving said slope adjusting rod to deflect to a certain angle, said slope adjusting rod driven to control said upper connecting rod to deflect for a certain angle and be positioned in place.

5. The walk simulating machine as claimed in claim 2, wherein said slope adjuster is provided with a slope adjusting rod, a positioning disk, an adjusting lever, a locking pin and a pressing rod, said slope adjusting rod transversely inserted through said front post and positioned under said horizontal rod, said slope adjusting rod having opposite sides respectively secured with a crank, each said crank pivotally connected with a movable disk, each said movable disk having an outer side provided with two position-limiting studs extending outward, said two position-limiting studs respectively positioned at the front and the rear side of said upper connecting rod, said positioning disk having one side secured with said front post and the other side formed with spaced-apart positioning recesses with positional angular difference, said adjusting lever having an upper end vertically fixed with said slope adjusting rod, said locking pin having an engage end transversely inserted through said adjusting lever and positioned in one of said positioning recesses of said positioning disk, said locking pin having a spring fitted inside to keep said engage end engaged and positioned in said positioning recess of said positioning disk, said pressing rod having its intermediate portion pivotally connected with said adjusting lever, said pressing rod having one end inserted in a connecting portion between said locking pin and said adjusting lever, said pressing rod pullable to control said engage end of said locking pin to disengage from one of said positioning recesses of said positioning disk, said upper connecting rod restricted by said slope adjuster not to sway back and forth arbitrarily, said upper connecting rod able to be adjusted to a sloping-up angle or a sloping-down angle.

6. The walk simulating machine as claimed in claim 2, wherein said slope adjuster is provided with a slope adjusting rod and an electrically-controlled device, said slope adjusting rod transversely inserted through said front post and positioned under said horizontal rod, said slope adjusting rod having opposite sides respectively fixed with a crank, each crank having an outer side pivotally assembled with a movable disk, each movable disk having one side provided with two position-limiting studs extending outward horizontally, said two position-limiting studs respectively positioned at the front and the rear side of said upper connecting rod, said electrically-controlled device driving said slope adjusting rod to shift and setting its deflected angle, said slope adjusting rod driven to control said upper connecting rod to deflect for a certain angle and be positioned in place.

* * * * *